US009644405B2

(12) United States Patent
McCann et al.

(10) Patent No.: US 9,644,405 B2
(45) Date of Patent: May 9, 2017

(54) DOOR SECURITY WEDGE DEVICE

(71) Applicant: Low Country Creative, LLC, Cobbs Creek, VA (US)

(72) Inventors: Chris McCann, Mathews, VA (US); Scott A. Witthaus, Cobbs Creek, VA (US)

(73) Assignee: LOW COUNTRY CREATIVE, LLC, Cobbs Creak, VA (US)

( * ) Notice: Subject to any disclaimer, the term of this patent is extended or adjusted under 35 U.S.C. 154(b) by 0 days.

(21) Appl. No.: 15/132,820

(22) Filed: Apr. 19, 2016

(65) Prior Publication Data

US 2016/0333617 A1 Nov. 17, 2016

Related U.S. Application Data

(60) Provisional application No. 62/159,568, filed on May 11, 2015.

(51) Int. Cl.

| | |
|---|---|
| ***E05C 17/44*** | (2006.01) |
| ***E05F 5/08*** | (2006.01) |
| ***E05B 63/00*** | (2006.01) |
| ***E05C 19/00*** | (2006.01) |
| *E05B 17/20* | (2006.01) |
| *E05C 17/54* | (2006.01) |

(52) U.S. Cl.

CPC ..... *E05C 17/446* (2013.01); *E05B 63/0004* (2013.01); *E05C 19/007* (2013.01); *E05F 5/08* (2013.01); *E05B 17/2084* (2013.01); *E05C 17/54* (2013.01)

(58) Field of Classification Search

CPC ..... E05C 17/446; E05F 5/08; E05B 17/2084
USPC ..... 292/342, 338, 204, 240, DIG. 15; 16/86
See application file for complete search history.

(56) References Cited

U.S. PATENT DOCUMENTS 258,127 A * 5/1882 Rosenthal ..... A01K 1/0017 292/233
453,930 A 6/1891 La Follette
463,226 A * 11/1891 Chase ..... E05C 17/54 254/39

(Continued)

OTHER PUBLICATIONS

International Search Report and Written Opinion for Appl. No. PCT/US2016/028321, Jul. 18, 2016, 9 pages.

*Primary Examiner* — Kristina Fulton
*Assistant Examiner* — Thomas Neubauer
(74) *Attorney, Agent, or Firm* — Patent Law of Virginia, PLLC; Brian J. Teague

(57) ABSTRACT

A device for preventing unauthorized opening of a door comprises a bracket, a main handle, and a wedge. The bracket is adapted for mounting the device to a door. The main handle is pivotably attached to the bracket. The main handle has a pivot end attached to the bracket and an opposing grasping end. The main handle is selectively pivotably movable upward and downward. The main handle is adapted such that pivoting the main handle upward moves the grasping end toward the door and pivoting the main handle downward moves the grasping end away from the door. The wedge is pivotably affixed to the main handle and biased toward the door when the main handle is in a downward position. The main handle is adapted to push a distal end of the wedge at least partly under a bottom surface of the door when the main handle is pivoted downward.

7 Claims, 5 Drawing Sheets

(56) References Cited

U.S. PATENT DOCUMENTS

| | | | | | |
|---|---|---|---|---|---|
| 944,628 | A * | 12/1909 | Morris | B25B 13/463 | 292/338 |
| 1,035,264 | A * | 8/1912 | Tate | E05F 11/00 | 292/342 |
| 1,157,376 | A * | 10/1915 | Franckaerts | E05B 15/004 | 292/147 |
| 1,297,189 | A * | 3/1919 | Lawler | E05F 11/00 | 292/342 |
| 1,661,240 | A * | 3/1928 | Trimbach | E05C 17/443 | 292/338 |
| 2,798,755 | A * | 7/1957 | Zapotocny | E05C 17/54 | 16/86 A |
| 2,898,140 | A * | 8/1959 | Gislason | E05C 17/54 | 16/82 |
| 4,163,574 | A | 8/1979 | Chezem | | |
| 4,759,577 | A * | 7/1988 | Thomas, III | E05C 17/443 | 292/338 |
| 4,805,948 | A * | 2/1989 | Renzi | E05C 17/54 | 292/342 |
| 5,590,928 | A | 1/1997 | Voiculescu | | |
| 6,659,018 | B1 * | 12/2003 | Jackson | E05B 15/0046 | 105/355 |
| 2012/0235428 | A1 * | 9/2012 | Blacklaws | E05C 19/004 | 292/338 |

* cited by examiner

DOOR SECURITY WEDGE DEVICE

CROSS-REFERENCE TO RELATED APPLICATIONS

This application claims priority to U.S. Provisional Application Ser. No. 62/159,568, filed May 11, 2015, the contents of which are incorporated herein by reference in its entirety.

FIELD OF THE INVENTION

The present invention relates to devices for securely holding doors closed.

BACKGROUND OF THE DISCLOSURE

Violent and often deadly incidents, including so-called "active shooter" incidents, are of great concern to many people. Ensuring the safety of the people in buildings in which such incidents may occur is critical, especially when such incidents occur in schools.

The common response to such incidents is for occupants of the building to "shelter-in-place," that is to remain in their rooms/offices, close the door, turn off the light, and wait for help to arrive. Occupants are instructed to lock their doors, however many classrooms and offices do not have locks on their doors. Retrofitting doors to add locks can be difficult and expensive, and such locks are often easily breached.

BRIEF SUMMARY

Briefly stated, one aspect of the present disclosure is directed to a device for preventing unauthorized opening of a door comprises a bracket, a main handle, and a wedge. The bracket is adapted for mounting the device to a door. The main handle is pivotably attached to the bracket. The main handle has a pivot end attached to the bracket and an opposing grasping end. The main handle is selectively pivotably movable upward and downward. The main handle is adapted such that pivoting the main handle upward moves the grasping end toward the door and pivoting the main handle downward moves the grasping end away from the door. The wedge is pivotably affixed to the main handle and biased toward the door when the main handle is in a downward position. The main handle is adapted to push a distal end of the wedge at least partly under a bottom surface of the door when the main handle is pivoted downward.

The device may further comprise a biasing spring for biasing the wedge toward the door when the main handle is in a downward position.

The device may further comprise one or more wedge attachment bars pivotably affixed at one end to the wedge and pivotably affixed at an opposite end to the main handle, such that the wedge is pivotably affixed to the main handle via the one or more attachment bars.

The device may further comprise a ratcheting wheel, such that the main handle is pivotably affixed to the bracket via the ratcheting wheel. The ratcheting wheel allows downward movement of the main handle and prevents upward movement of the main handle unless the ratcheting wheel is released.

The wedge may be pivotably affixed to the main handle at a position along the main handle that is closer to the pivot end than to the grasping end.

In an alternative embodiment of the invention, a device for preventing unauthorized opening of a door comprises a bracket, a main handle, a wedge, and a ratcheting wheel. The bracket is adapted for mounting the device to a door. The main handle is pivotably attached to the bracket. The main handle has a pivot end attached to the bracket and an opposing grasping end. The main handle is selectively pivotably movable upward and downward. The main handle is adapted such that pivoting the main handle upward moves the grasping end toward the door and pivoting the main handle downward moves the grasping end away from the door. The wedge is pivotably affixed to the main handle. The main handle is pivotably affixed to the bracket via the ratcheting wheel, such that the ratcheting wheel allows downward movement of the main handle and prevents upward movement of the main handle unless the ratcheting wheel is released. The main handle is adapted to push a distal end of the wedge at least partly under a bottom surface of the door when the main handle is pivoted downward. The wedge may be biased toward the door when the main handle is in a downward position In another alternative embodiment of the invention, a device for preventing unauthorized opening of a door comprises a bracket, a main handle, and a wedge. The bracket is adapted for mounting the device to a door. The main handle is pivotably attached to the bracket. The main handle has a pivot end attached to the bracket and an opposing grasping end. The main handle is selectively pivotably movable upward and downward. The main handle is adapted such that pivoting the main handle upward moves the grasping end toward the door and pivoting the main handle downward moves the grasping end away from the door. The wedge is pivotably affixed to the main handle at a position along the main handle that is closer to the pivot end than to the grasping end. The main handle is adapted to push a distal end of the wedge at least partly under a bottom surface of the door when the main handle is pivoted downward. The wedge may be biased toward the door when the main handle is in a downward position.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
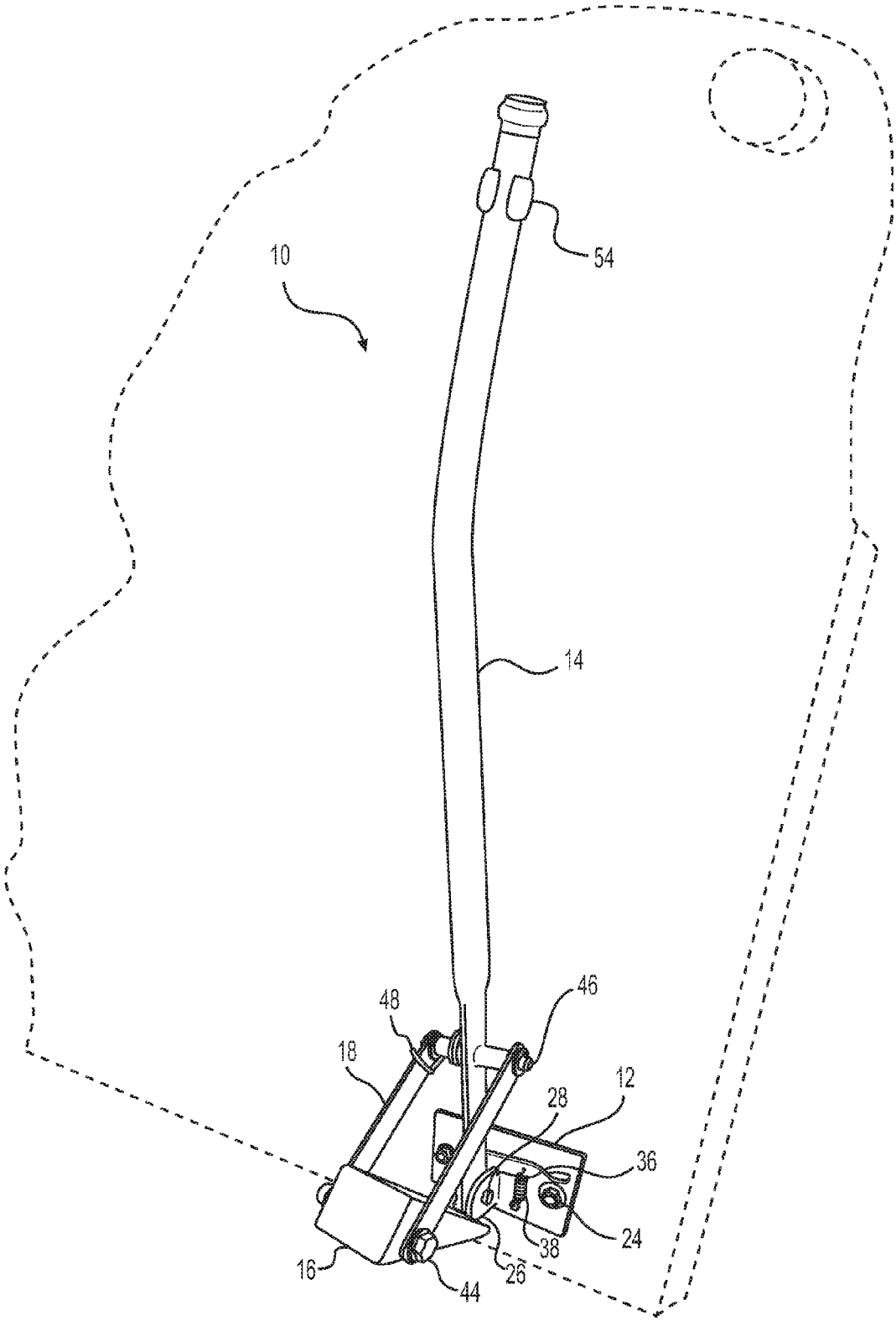
FIG. 1 is a perspective view of a door security wedge device, in an undeployed position, in accordance with embodiments of the present invention.

Certain terminology is used in the following description for convenience only and is not limiting. The words "lower," "bottom," "upper," and "top" designate directions in the drawings to which reference is made. The words "inwardly,"

"outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to a device for holding a door securely closed, particularly in an emergency, using a spring-loaded deployment system to activate a door blocking wedge. The device of embodiments of the invention, which may be termed the "Rapid Shelter Door System," may be easily retrofitted to existing doors or may be pre-installed on new doors. In contrast to other door security products, the Rapid Shelter Door System uses one simple gross motor movement to consistently deploy. Additional "wedging power" can be applied by adding more pressure to deployment bar after spring-loaded deployment. Installed properly, there is little chance of inaccurate deployment, as the structure and operation of the device makes sure the wedge is properly inserted between the door and floor.

The Rapid Shelter Door System was designed to buy valuable time in active-shooter or terrorist incidents when "shelter-in-place" is the best strategy. The device of embodiments of the invention works in conjunction with in-place security measures, and is well-suited for education, government, and corporate environments. The device of embodiments of the invention can also work in residential markets for "safe-room" uses. The device of embodiments of the invention is easily installed on existing doors, and, once installed, is always in place and ready.

The device of embodiments of the invention uses a spring mechanism to position a wedge under a door. After spring deployment, additional pressure on the deployment bar will add more blocking power. The device of embodiments of the invention provides one-move deployment using large muscle groups that anyone can activate. The device of embodiments of the invention saves valuable time in the first moments of a crisis.

Referring now to FIGS. 1-5, a perspective view of a door security wedge device is illustrated, in accordance with embodiments of the present invention. Device 10 is shown in FIG. 1 in the undeployed or ready-to-be-deployed position. In the illustrated embodiments of the invention, door security wedge device 10 comprises a mounting bracket 12 affixed securely to a door (preferably a sturdy door such as a metal door or a solid wood door), a main handle 14 for deploying the device, a wedge 16 which is deployed between the door and the floor as described below to prevent the door from being opened (when the device is deployed), and one or more (two are shown) wedge attachment bars 18 pivotably affixing the wedge 16 to the main handle 14. The door security wedge device of embodiments of the present invention is typically mounted on the inside surface of an inward swinging door.

The mounting bracket 12 is secured to the door using any suitable hardware, such as bolts 24 that protrude through holes in the bracket (not seen) and corresponding holes drilled in the door (not seen), or any other suitable attachment means or mechanism (e.g., welding to a metal door). The mounting bracket is mounted near the bottom edge of the door and near the free-swinging side (i.e., opposite the hinge side) of the door, in a location that enables the door to operate properly when the device is undeployed but that enables the wedge to be properly deployed between the door and floor. The precise location may vary somewhat depending on the exact size/dimensions of the device.

The mounting bracket 12 comprises two spaced-apart vertical flanges 26 projecting outward perpendicularly from the main body of the bracket. A proximal or pivoting end of the main handle 14 is pivotably affixed to the flanges 16 via an axle or bolt 28. The proximal end of the main handle 14 is inserted between the flanges 26 and the bolt 28 protrudes through corresponding holes in the flange(s) and in the proximal end of the main handle. The main handle may be pivotably or hingedly affixed to the bracket in any other suitable way.

A ratchet wheel 34 is affixed to or integral with the proximal end of the main handle 14 and rotates (top outward) when the main handle is pivoted out and down for deployment. The ratchet wheel 34 engages with a ratchet bar 36 that is pivotably or hingedly affixed to the mounting bracket 12. The ratchet bar 36 has a pivot end and a free end, as shown, and the free end is biased downward against the ratchet wheel 34 by spring 38. The ratchet bar 36 enables the main handle to be pivoted out and down, but restricts movement of the main handle 14 in the opposite direction unless the ratchet is released by a user lifting up on the free end of the ratchet bar 36. (As in a conventional ratchet, it is the shape of the teeth that allows movement in one direction but not in the opposite direction unless the ratchet is released.) Any other suitable mechanism may be used to enable the main handle to be pivoted out and down, but restrict movement of the main handle in the opposite direction until released.

Figure 2:
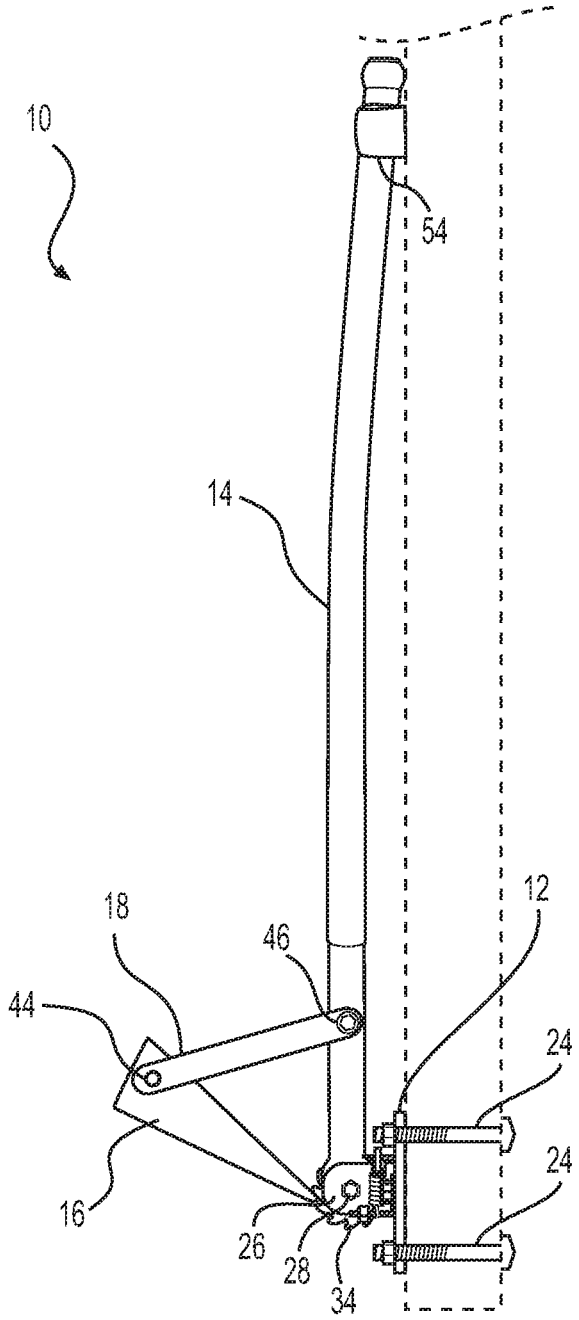
FIG. 2 is a side view of the device of FIG. 1, in the undeployed position.

As described above, the main handle 14 is pivotably affixed to the mounting bracket 12. The main handle is elongated to provide sufficient leverage to force the wedge 16 firmly between the door and the floor during deployment. The main handle 14 is constructed of any suitable strong and rigid material, such as steel or aluminum. The main handle 14 may be substantially straight or may be bent or curved. In the illustrated embodiment, the main handle bends outward. The main handle 14 is substantially vertical when not deployed, as seen in FIG. 2. A retaining clip 54 may be affixed to the door at a position to frictionally (or otherwise) retain the distal end of the main handle 14 in the upright, undeployed position until needed to be deployed. The retaining clip should be structured such that little force is required to remove the distal end from the clip for deployment. In one embodiment of the invention, the main handle is about 32-34 inches long.

One or more (two are illustrated) wedge attachment bars 18 are pivotably affixed to the main handle 14 via axle 46. A spring 48 or other suitable mechanism biases the wedge attachment bars 18 (and therefore the wedge 16) toward the door. In the illustrated embodiment, the spring 48 is affixed to one of the wedge attachment bars 18 and the axle 46. Alternatively, the spring (or other biasing mechanism) may be affixed to one or both of the wedge attachment bars and to the main handle.

The wedge 16 is pivotably affixed to the distal ends of the wedge attachment bars 18 via bolt or axle 44 (or any other suitable pivoting mechanism). As illustrated, the wide end of the wedge 16 is affixed to the wedge attachment bars 18, and the narrow end of the wedge 16 can move freely. The wedge is constructed out of any suitable material that is sturdy and has a sufficient coefficient of friction relative to the floor surface to resist movement when wedged between the door and the floor. For example, the wedge may be constructed of hard rubber for use with vinyl, tile, or wood floors, or may be constructed of wood for use with carpeted floors.

As illustrated, the wedge is pivotably affixed to the main handle (via the attachment bars) at a position that is closer to the proximal end (i.e., where the main handle attaches to the mounting bracket) than to the distal end (i.e., the end of the main handle that is grasped by a user). In other words, a significant portion of the main handle extends upward beyond where the wedge attaches. This relative positioning of wedge attachment point and elongated extension of the main handle beyond the wedge attachment point ensures that a user can apply sufficient leverage to force the wedge under the bottom edge of the door (as described further below).

As illustrated in FIGS. 1 and 2, when the device 10 is not deployed, the main handle 14 is substantially vertical and the distal (upper end) of the main handle is retained by the retaining clip 54. In this position, the device 10 does not obstruct normal operation of the door but is ready to be quickly deployed in the event of an emergency that requires the door be closed securely to allow the occupants to shelter-in-place. As seen in FIGS. 1 and 2, the wedge 18 is above the floor and held away from the door by the flanges 26 (despite the biasing force of the spring 48).

Figure 3:
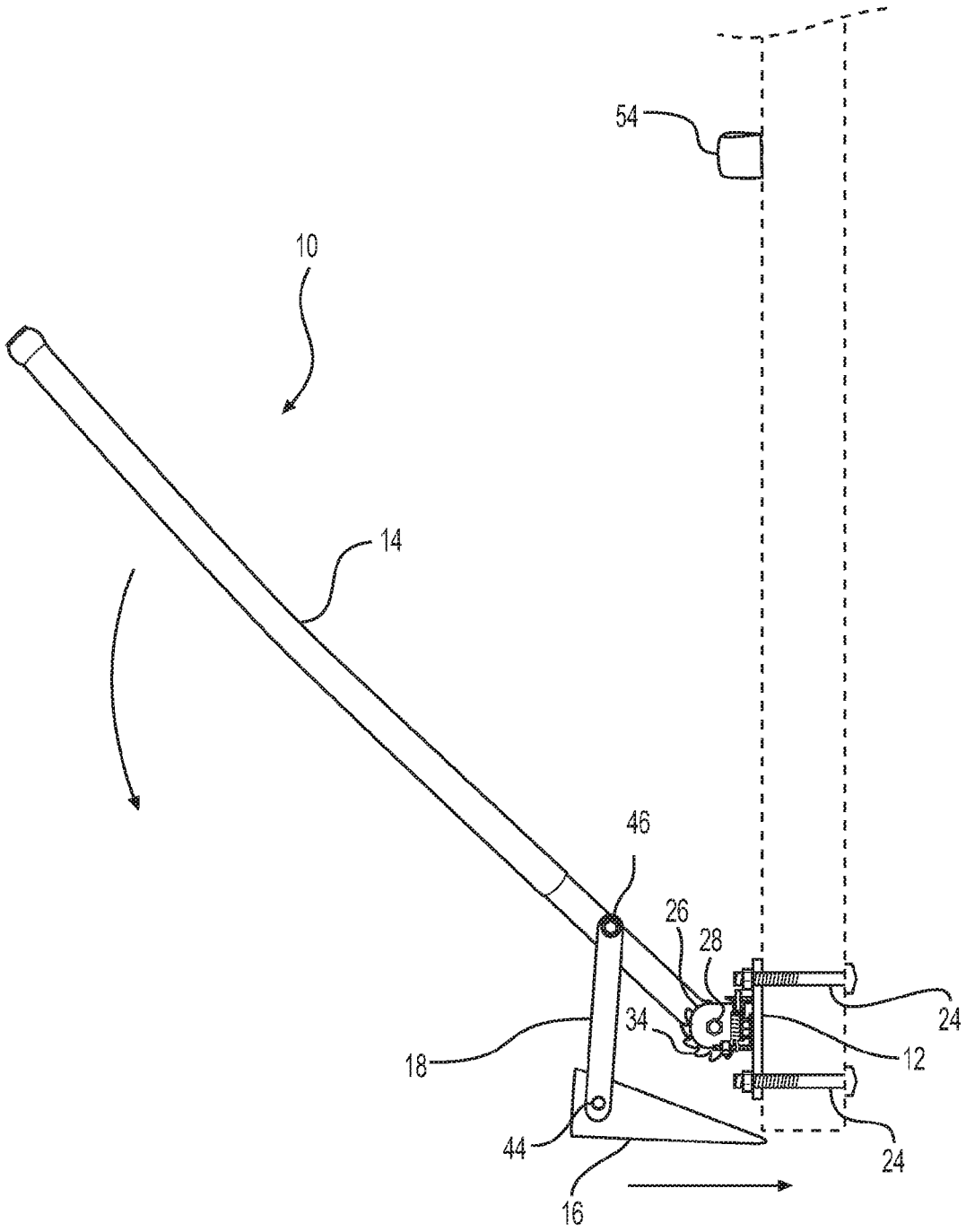
FIG. 3 is a side view of the device of FIG. 1, in a partially deployed position.
Figure 4:
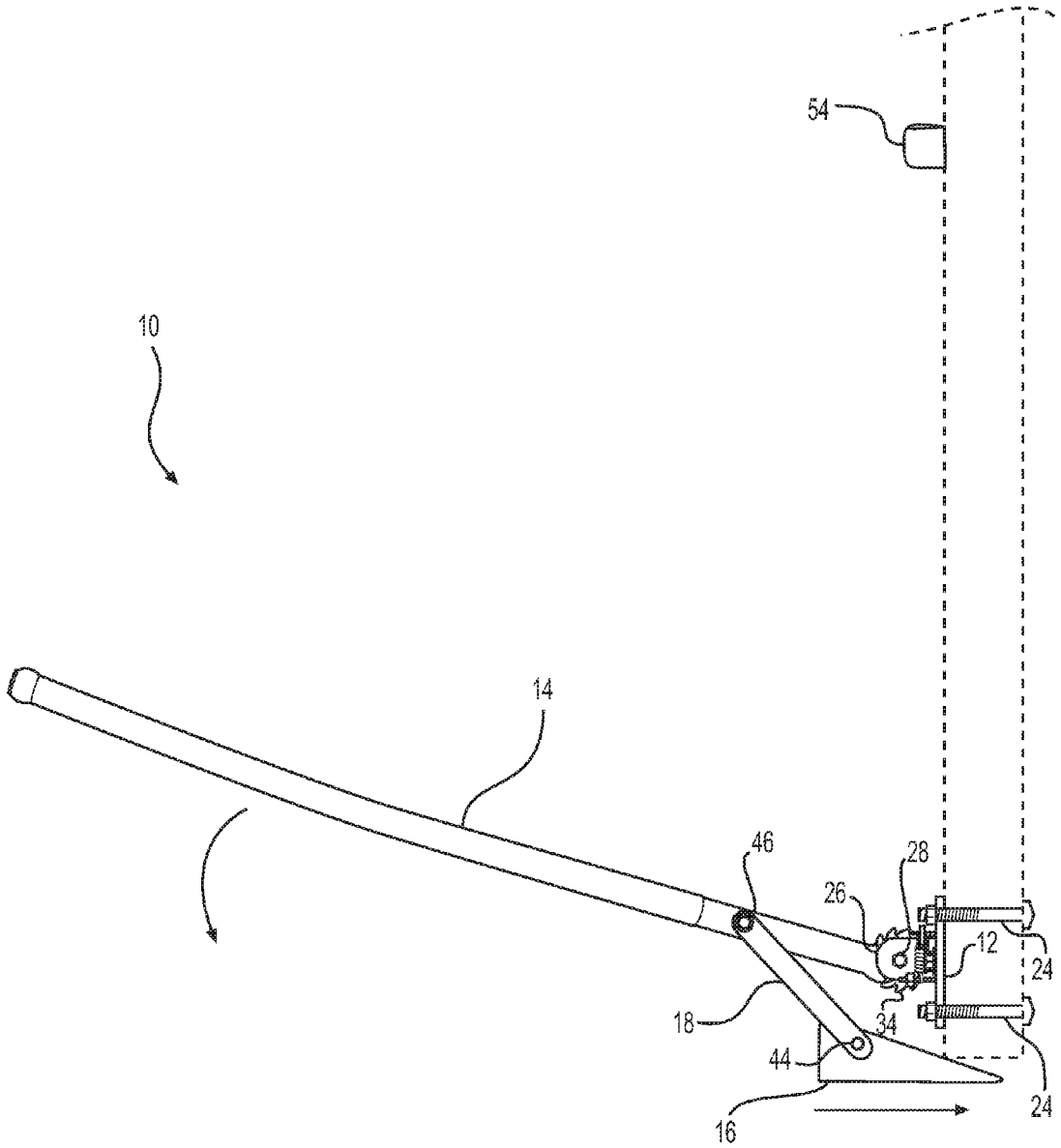
FIG. 4 is a side view of the device of FIG. 1, in a fully deployed position.
Figure 5:
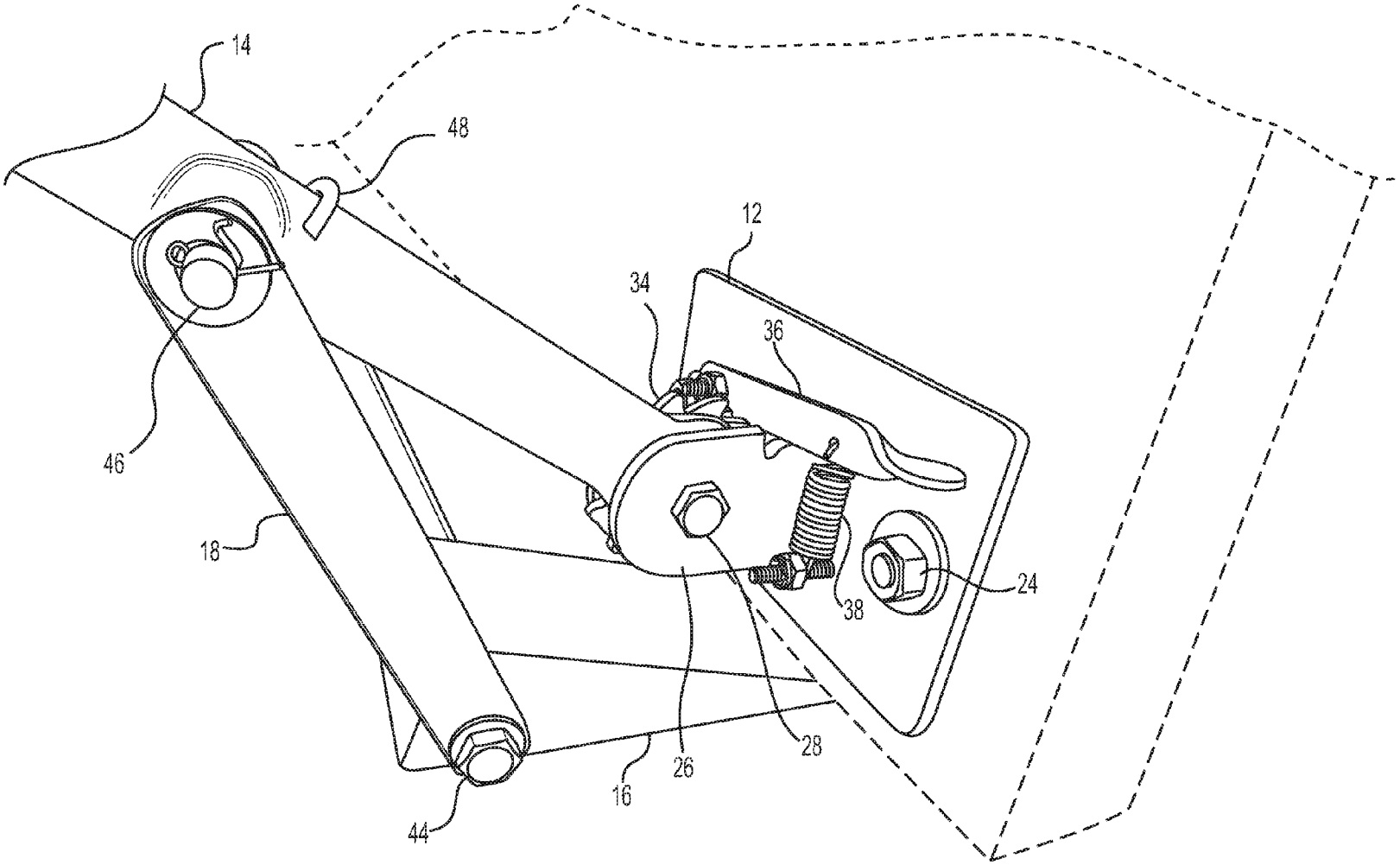
FIG. 5 is a close-up perspective view of a portion of the device of FIG. 1.

When the device 10 is to be deployed, a user grasps the distal end of the main handle 14 and pulls out and down, thereby pivoting the main handle 14 away from the door. As the main handle 14 pivots away from the door, the connection between the main handle 14 and the wedge 16 (via the attachment bars 18) causes the wide end of the wedge 16 to be pushed down. At a certain point in the pivoting of the main handle 14 and the downward movement of the wedge 16 (before the device is fully deployed; about when the main handle is at roughly a 45 degree angle, as seen in FIG. 3), the narrow end of the wedge 16 will lose contact with the flanges 26 (which had been holding the wedge away from the door, as described above), thereby allowing the biasing force of the spring 48 to pivot the wedge 16 downward and toward the door until the wedge is on the floor and the narrow end of the wedge is at least somewhat under the door. The biasing force of the spring is typically not sufficient to fully seat the wedge under the door to point where the door cannot be opened. Rather, at this point, the wedge is positioned properly to enable full deployment (in which the wedge is strongly forced under the door).

As the user continues to pivot the main handle 14 downward toward the floor, the user applies very firm downward pressure on the main handle 14, thereby forcing the wedge 16 further toward the door and further under the door. The force may be sufficient to also deflect the bottom edge of the door inward. In this regard, the wedge 16 becomes very securely wedged under the door, making it extremely difficult (if not impossible) for someone to force the door open while the device 10 is deployed. The length of the main handle 14 provides the leverage necessary for a user (even if the user has limited upper body strength) to force the wedge securely under the door. The user may position his/her upper body over the distal end of the main handle to use his/her body weight, if necessary, to apply sufficient downward pressure to fully seat the wedge under the door.

The door security wedge device of embodiments of the invention can be quickly deployed (in about 2.5 seconds during testing of the device), with simple gross-motor movements that are easily performed during a stressful incident.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A device for preventing unauthorized opening of a door, the device comprising:

a bracket adapted for mounting the device to a door;

a main handle pivotably attached to the bracket, the main handle having a pivot end attached to the bracket and an opposing grasping end, the main handle selectively pivotably movable upward and downward, the main handle adapted such that pivoting the main handle upward moves the grasping end toward the door and pivoting the main handle downward moves the grasping end away from the door;

a wedge pivotably affixed to the main handle via one or more wedge attachment bars, each attachment bar pivotably affixed at one end to the wedge and pivotably affixed at an opposite end to the main handle;

a biasing spring for biasing the wedge toward the door when the main handle is in a downward position; and a ratcheting wheel;

wherein the main handle is pivotably affixed to the bracket via the ratcheting wheel;

wherein the ratcheting wheel allows downward movement of the main handle and prevents upward movement of the main handle unless the ratcheting wheel is released; and wherein the main handle is adapted to push a distal end of the wedge at least partly under a bottom surface of the door when the main handle is pivoted downward.

2. The device of claim 1, wherein the wedge is pivotably affixed to the main handle at a position along the main handle that is closer to the pivot end than to the grasping end.

3. A device for preventing unauthorized opening of a door, the device comprising:

a bracket adapted for mounting the device to a door;

a main handle pivotably attached to the bracket, the main handle having a pivot end attached to the bracket and an opposing grasping end, the main handle selectively pivotably movable upward and downward, the main handle adapted such that pivoting the main handle upward moves the grasping end toward the door and pivoting the main handle downward moves the grasping end away from the door;

a wedge pivotably affixed to the main handle via one or more wedge attachment bars, each attachment bar pivotably affixed at one end to the wedge and pivotably affixed at an opposite end to the main handle; and a ratcheting wheel;

wherein the main handle is pivotably affixed to the bracket via the ratcheting wheel;

wherein the ratcheting wheel allows downward movement of the main handle and prevents upward movement of the main handle unless the ratcheting wheel is released; and wherein the main handle is adapted to push a distal end of the wedge at least partly under a bottom surface of the door when the main handle is pivoted downward.

4. The device of claim 3, further comprising:

a biasing spring for biasing the wedge toward the door when the main handle is in a downward position.

5. The device of claim 3, wherein the wedge is pivotably affixed to the main handle at a position along the main handle that is closer to the pivot end than to the grasping end.

6. A device for preventing unauthorized opening of a door, the device comprising:

a bracket adapted for mounting the device to a door;

a main handle pivotably attached to the bracket, the main handle having a pivot end attached to the bracket and an opposing grasping end, the main handle selectively pivotably movable upward and downward, the main handle adapted such that pivoting the main handle upward moves the grasping end toward the door and pivoting the main handle downward moves the grasping end away from the door;

a wedge pivotably affixed to the main handle at a position along the main handle that is closer to the pivot end than to the grasping end, the wedge being pivotably affixed to the main handle via one or more wedge attachment bars, each attachment bar pivotably affixed at one end to the wedge and pivotably affixed at an opposite end to the main handle;

a biasing spring for biasing the wedge toward the door when the main handle is in a downward position; and a ratcheting wheel;

wherein the main handle is pivotably affixed to the bracket via the ratcheting wheel;

wherein the ratcheting wheel allows downward movement of the main handle and prevents upward movement of the main handle unless the ratcheting wheel is released; and wherein the main handle is adapted to push a distal end of the wedge at least partly under a bottom surface of the door when the main handle is pivoted downward.

7. The device of claim 3, wherein the wedge is biased toward the door when the main handle is in a downward position.

* * * * *